US005877684A

United States Patent [19]

Lu

[11] Patent Number: 5,877,684

[45] Date of Patent: Mar. 2, 1999

[54] SENSOR EQUIPPED PORTABLE ALARM DEVICE WHICH CAN BE USED IN CONJUNCTION WITH EXTERNAL ALARM DEVICE

[75] Inventor: Chung-Chien Lu, Hsinchu, Taiwan

[73] Assignee: United Microelectronics Corp., Hsin-chu, Taiwan

[21] Appl. No.: 56,252

[22] Filed: Apr. 7, 1998

[30] Foreign Application Priority Data

Feb. 7, 1998 [TW] Taiwan ..... 87201803

[51] Int. Cl.[6] ..... G08B 19/00

[52] U.S. Cl. ..... 340/521; 340/541; 340/628; 340/693.5

[58] Field of Search ..... 340/521, 540, 340/541, 628, 693.5

[56] References Cited

U.S. PATENT DOCUMENTS 4,716,402 12/1987 Francis ..... 34/693.5
4,841,282 6/1989 Reis ..... 340/521
5,309,145 5/1994 Branch et al. ..... 340/540
5,751,214 5/1998 Cowley et al. ..... 340/573.1
5,786,767 7/1998 Severino ..... 340/628

*Primary Examiner*—Jeffery A. Hofsass
*Assistant Examiner*—Julie B. Lieu
*Attorney, Agent, or Firm*—Knobbe, Martens, Olson & Bear, LLP

[57] ABSTRACT

A sensor equipped portable alarm device that also has an input port for connecting to an external sensor so that either the internal sensor or the external sensor can be selected using a sensor select switch. Furthermore, the alarm device has a timer for setting a delay time so that errors arising from immediate action on start-up can be avoided. In addition, the device has a magnetic base for mounting on a magnetic surface and dismounting when the device is no longer needed. Moreover, a rechargeable internal battery is used as an internal power source for the whole device, but power drawn from an external power source can also be used as well. Therefore, the device is portable and can be used anywhere.

13 Claims, 3 Drawing Sheets

SENSOR EQUIPPED PORTABLE ALARM DEVICE WHICH CAN BE USED IN CONJUNCTION WITH EXTERNAL ALARM DEVICE

CROSS-REFERENCE TO RELATED APPLICATION

This application claims the priority benefit of Taiwan application Ser. No. 87201803, filed Feb. 7, 1998, the full disclosure of which is incorporated herein by reference.

BACKGROUND OF THE INVENTION

1. Field of Invention

The present invention relates to a sensor equipped alarm device. More particularly, the present invention relates to a portable, internally powered and sensor-equipped alarm device that can be mounted anywhere.

2. Description of Related Art

A conventional security alarm system contains power circuits, sensors, amplifier circuits, warning sound and flashing light control circuits, all of which must be individually designed. FIG. 1 is a block diagram showing the component parts of a conventional security alarm system. As shown in FIG. 1, the system includes a sensor 2, an amplifier 4, a power circuit 6, an alarm generator 8 and an alarm-reporting device 10. First, information regarding any changes in the external environment is fed to the sensor 2. For example, the sensor 2 can be an infrared sensor, which constantly samples infrared signals from its surrounding space. Next, the signals are sent to the alarm generator 8 via the amplifier 4. Finally, the alarm-reporting device 10 picks up warning signals from the alarm generator 8 and informs the user about the current situation. The alarm reporting device 10 can be a buzzer or a light emitting diode (LED), for example. Furthermore, an external power source enters the system via the power circuit 6 and supplies electrical power to the sensor 2, the amplifier 4 and the alarm generator 8.

Each component in the above security alarm system has to be individually designed. Moreover, once the system is designed, it is very difficult to select other sensors or alarm devices more appropriate for the situation. In addition, an external power source must always be nearby and the system will be activated as soon as the power is switched on. Therefore, the system is difficult to install and is particularly wasteful when the security alarm system is needed only for short periods of time.

In light of the foregoing, there is a need to provide a portable and flexible alarm device.

SUMMARY OF THE INVENTION

Accordingly, the present invention is to provide a sensor-equipped, portable alarm device that has external input/output ports for connecting to an external sensor and an external warning device so that a sensor select switch can be used to select sensors appropriate for the situation, whether it be the internally equipped sensor or another external sensor.

In another aspect, the invention is to provide a sensor equipped portable alarm device having a timer and a time delay selector for setting a preset delay period before the installed device is active. Hence, erroneous action immediately after the device is activated can be avoided.

In yet another aspect, the invention is to provide a sensor equipped portable alarm device that has a magnetic base so that the device can be installed anywhere on a magnetic surface. Therefore, mounting and dismounting of the device is very convenient.

In one further aspect, the invention is to provide a sensor-equipped, portable alarm device that includes an internal battery. The internal battery is capable of providing the necessary electrical power to the internal sensor, amplifier, alarm generator circuit, timer and direct current power outlet for the external sensor. Moreover, external power can be supplied to the device via a power source inlet.

To achieve these and other advantages and in accordance with the purpose of the invention, as embodied and broadly described herein, the invention provides a sensor-equipped portable alarm device capable of detecting a change in an external signal, and also capable of connecting to an external sensor and an external warning device. The alarm device comprises the following: an internal sensor for detecting the change in an external signal and outputting a first signal; an amplifier for receiving the first signal and then amplifying the first signal so that an amplified second signal is output; a mode select switch for receiving the second signal and outputting a third signal depending on the selection of activation mode for the internal sensor; an input port connected to an external sensor for detecting change in external signal and transmitting a fourth signal; a sensor select switch for selecting either the third signal or the fourth signal and then outputting a fifth signal; a timer having a time delay selector for delaying action for a preset period after receiving the fifth signal and then outputting a sixth signal; an alarm generator circuit for receiving the sixth signal and then generating an alarm signal; a changeover select switch for receiving the alarm signal and then generating either a seventh signal or an eighth signal; an internal warning device for receiving the seventh signal and then sending out warning signals; an output port connected to an external warning device for receiving the eighth signal and then sending out warning signals; a power supply for providing the necessary electrical power to the internal sensor, the amplifier, the timer and the alarm generator circuit; and a magnet located at the bottom part of the device for mounting convenience.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
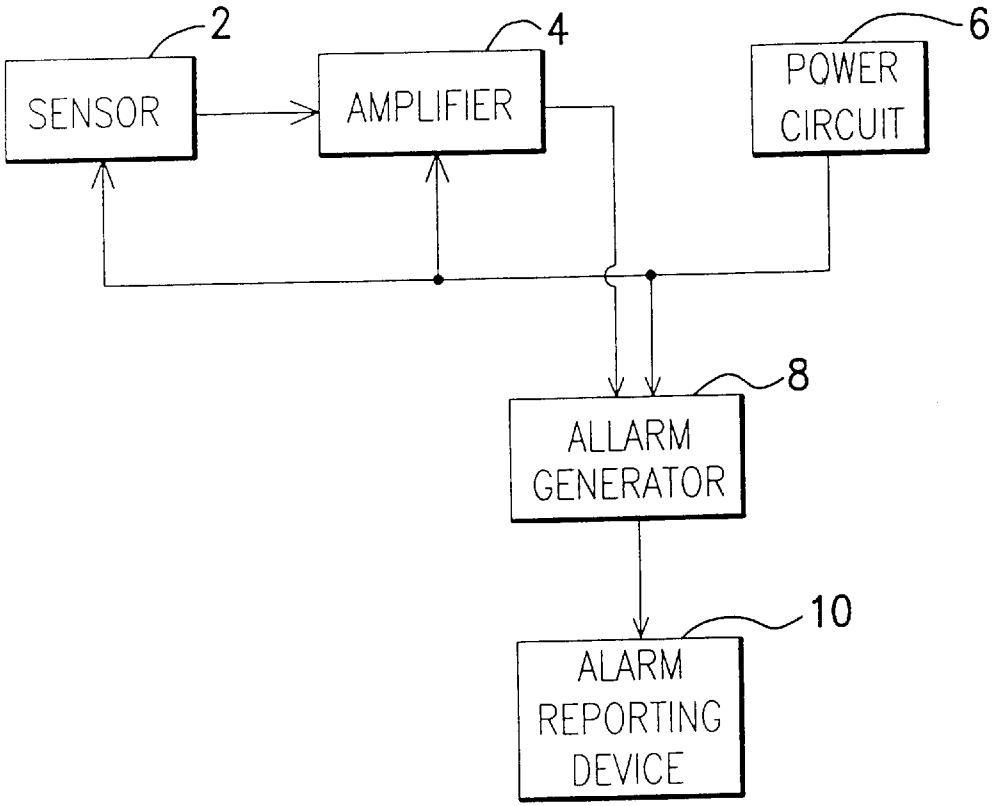
FIG. 1 (PRIOR ART)
FIG. 1 is a block diagram showing the component parts of a conventional security alarm system.

Reference will now be made in detail to the present preferred embodiments of the invention, examples of which are illustrated in the accompanying drawings. Wherever possible, the same reference numbers are used in the drawings and the description to refer to the same or like parts.

Figure 2:
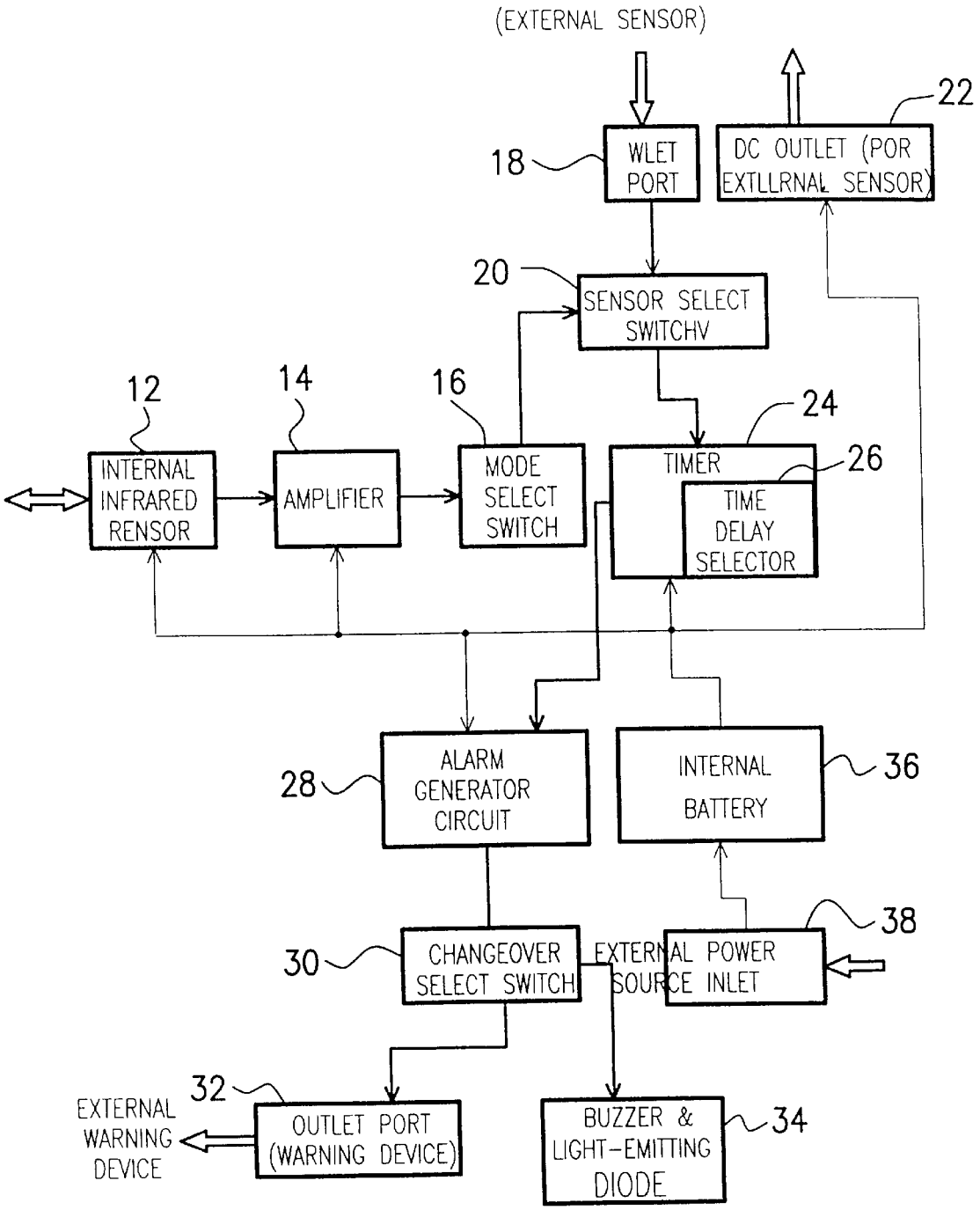
FIG. 2 is a block diagram showing the functional layout of a sensor equipped portable alarm device according to this invention.

FIG. 2 is a block diagram showing the functional layout of a sensor equipped portable alarm device according to this invention. First, as shown in FIG. 2, an internal infrared sensor 12 is used to detect any changes in the surrounding areas. Then, any signal variation is delivered to an amplifier 14. Thereafter, the signals are passed into mode select switch 16, where the mode of activation for the sensor can be selected. For example, two modes can be selected using the mode select switch 16, namely a light passing mode and a light cut-off mode. In the meantime, an external sensor, for example, an ultra-sound sensor, can be connected to the device through an input port 18. Detected signals from both the internal infrared sensor 12 and the external sensor are ultimately sent to a sensor select switch 20. Signals from one of the sensors are selected through this sensor select switch 20. Next, a signal from the sensor select switch 20 is sent to a timer 24. The timer 24 has a time delay selector 26 for controlling the time delay before an alarm generator circuit 28 starts to operate. As an illustration, the time delay selector 26 in this example has three settings including a ten second, a minute and a ten minute interval.

As soon as the preset period of delay for the timer 24 has passed, the alarm generator circuit 28 is allowed to operate. If the internal infrared sensor 12 or the external sensor detects any signal variation, the alarm generator 28 will send out a signal to a changeover select switch 30. From the changeover select switch 30, the signal can be routed to an internal warning device 34, for example, a buzzer or a light emitting diode. Alternatively, the signal can be routed to an external warning device via an output port 32. The external warning device, for example, can be a counter for computing the frequency of variation and other related data, or can be a controller for controlling other power sources and relays serving as an extension to the alarm device.

Electrical power for various internal components including the infrared sensor 12, the amplifier 14, the alarm generator circuit 28 and the timer 24 is supplied by an internal battery 36. Therefore, the device does not necessarily have to be installed next to a power source. As long as the internal battery 36 is fully charged, the device can to be installed almost anywhere. When the internal battery 36 runs out of power, there is an external power source inlet 38 in the device for plugging into an external power source and charging up the battery 36. The internal battery 36 also has a power outlet 22 for supplying power to other external sensors as well.

Figure 3:
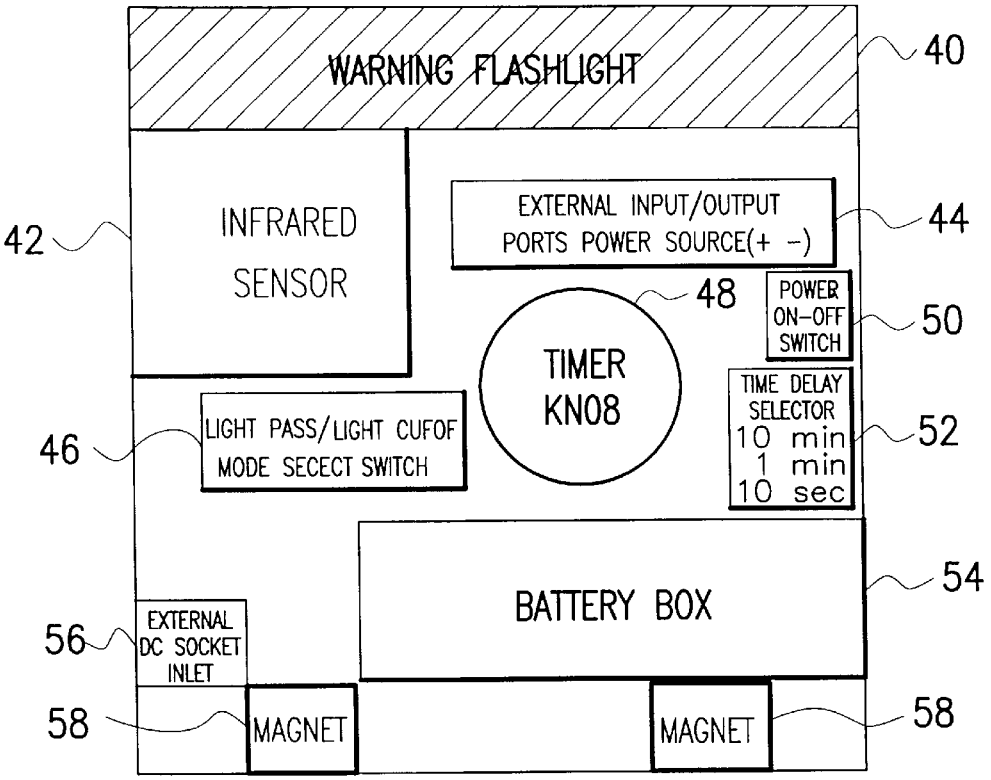
FIG. 3 is a cut-open view of a sensor equipped portable alarm device according to this invention.

FIG. 3 is a cut-open view of a sensor-equipped portable alarm device according to this invention. As shown in FIG. 3, the uppermost part contains a warning flashlight 40. On the left just below the flashlight 40 is an infrared sensor 42 for detecting any changes in surrounding areas. Just below the infrared sensor 42, there is mode select switch 46 where a light passing mode or a light cut-off mode can be selected. On the right, just below the flashlight 40, there are external input/output ports for connection to an external sensor and an external alarm device, and positive/negative terminals of the battery power source for supplying power to external device 44. Below the external input/output ports and battery power source 44 is a power on-off switch 50 for controlling the power to every component of the device. There is a timer knob 48 on the left of the power on-off switch 50. Below the power on-off switch 50, there is a time delay selector 52 having three settings including a ten minute, a minute and a ten second interval. Further below is a battery box 54 for holding the internal battery, which supplies power to all internal components. On the left of the battery 54, there is an external direct current socket 56 for charging up the battery. On the bottom part of the device are two magnets 58 for the convenience of mounting and dismounting the device onto a magnetic surface.

Figure 4:
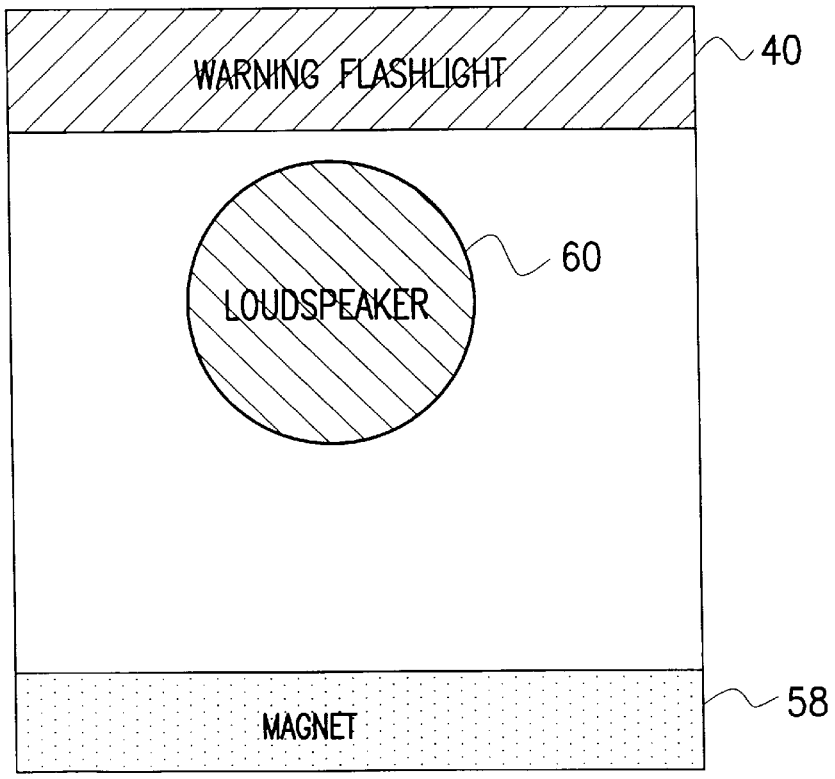
FIG. 4 is a side view of a sensor equipped portable alarm device according to this invention.

FIG. 4 is a side view of a sensor equipped portable alarm device according to this invention. The upper part is still occupied by the flashlight 40, and there is a loudspeaker 60 below the flashlight 40. The loudspeaker 60 is used for producing a warning sound such as a buzzing tone. Again, the magnets 58 at the bottom of the device are used for mounting.

This invention provides a sensor equipped portable alarm device that has external input contacts for allowing connection to external sensors as well. Therefore, the user can choose whether to use an external sensor or the internally equipped sensor through a selection switch. Furthermore, the invention has a timer for selecting the necessary delay before the system is activated, thereby avoiding unnecessary start-up errors. Another advantage of this invention is the use of a magnetic base. With a magnetic base, the device can be set up almost anywhere and can be dismantled with ease. Finally, by using a re-chargeable internal battery, necessary power can be supplied to the internal sensor, the amplifier, the alarm generator circuit and timer, avoiding the trouble of having to install the unit next to a power source. In addition, the internal battery can also provide a direct current power outlet for supplying power to an external sensor.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A sensor-equipped portable alarm device capable of detecting a change in external signals and of being connected to an external sensor and an external warning device, comprising:

an internal sensor for detecting the change in external signals and outputting a first signal;

an amplifier for receiving the first signal and then amplifying the first signal so that an amplified second signal is output;

a mode select switch for receiving the second signal and outputting a third signal depending on the selection of activation mode for the internal sensor;

an input port connected to an external sensor for detecting change in external signal and transmitting a fourth signal;

a sensor select switch for selecting either the third signal or the fourth signal and then outputting a fifth signal;

a timer having a time delay selector for delaying action after receiving the fifth signal for a preset period and then outputting a sixth signal;

an alarm generator circuit for receiving the sixth signal and then generating an alarm signal;

a changeover select switch for receiving the alarm signal and then generating either a seventh signal or an eighth signal;

an internal warning device for receiving the seventh signal and then sending out warning signals;

an output port connected to an external warning device for receiving the eighth signal and then sending out warning signals;

a power supply for providing the necessary electrical power to the internal sensor, the amplifier, the timer and the alarm generator circuit; and a magnet located at the bottom part of the device for mounting convenience.

2. The device of claim 1, wherein the internal sensor includes an infrared sensor.

3. The device of claim 2, wherein the mode of activation includes light passing into the infrared sensor.

4. The device of claim 2, wherein the mode of activation includes light cut-off from the infrared sensor.

5. The device of claim 1, wherein the external sensor includes an ultra-sound sensor.

6. The device of claim 1, wherein the time delay that can be selected by the time delay selector includes a ten minute, a minute and a ten second interval.

7. The device of claim 1, wherein the internal warning device includes a buzzer.

8. The device of claim 1, wherein the internal warning device includes a light emitting diode.

9. The device of claim 1, wherein the external warning device includes a counter.

10. The device of claim 1, wherein the power supply includes an internal battery and an external power source inlet.

11. The device of claim 10, wherein the power supply further includes a direct current power outlet for an external sensor.

12. The device of claim 11, wherein power for the direct current power outlet is provided by the internal battery.

13. The device of claim 10, wherein the external power source inlet can be connected to an external power source so that power can be supplied to the whole alarm device.

* * * * *